United States Patent [19]

Fujimoto

[11] 4,248,417

[45] Feb. 3, 1981

[54] SHEET FEED MECHANISM COMPRISING ONE-ROTATION CLUTCH AND SUCTION FOOT ASSEMBLY

[75] Inventor: Sakae Fujimoto, Tokyo, Japan

[73] Assignee: Ricoh Company, Ltd., Tokyo, Japan

[21] Appl. No.: 860,495

[22] Filed: Dec. 14, 1977

Related U.S. Application Data

[63] Continuation of Ser. No. 666,295, Mar. 12, 1976, abandoned.

[30] Foreign Application Priority Data

| | | | |
|---|---|---|---|
| Mar. 12, 1975 | [JP] | Japan | 50/33774 |
| Jun. 17, 1975 | [JP] | Japan | 50/74035 |
| Sep. 29, 1975 | [JP] | Japan | 50/117496 |

[51] Int. Cl.[2] ..... B65H 3/08; B65H 3/48; F16D 11/00

[52] U.S. Cl. ..... 271/98; 192/28; 192/33 R; 271/11; 271/106; 271/107

[58] Field of Search ..... 271/11, 14, 90, 97, 271/98, 103, 104, 106, 107, 108; 192/33 R, 28, 101

[56] References Cited

U.S. PATENT DOCUMENTS

| | | | |
|---|---|---|---|
| 1,433,423 | 10/1922 | Stevens | 271/103 |
| 1,698,416 | 1/1929 | Reiss | 192/33 R X |
| 2,242,674 | 5/1941 | Holt | 192/28 X |
| 2,289,237 | 7/1942 | Brown | 271/11 UX |
| 2,698,175 | 12/1954 | Rowell | 271/11 |
| 2,722,416 | 11/1955 | Backhouse | 271/108 X |
| 2,745,665 | 5/1956 | Labombarde | 271/106 X |
| 3,033,562 | 5/1962 | Kretz | 271/98 |
| 3,241,830 | 3/1966 | Wagner | 271/107 X |
| 3,448,978 | 6/1969 | Gibson | 271/11 |
| 3,785,640 | 1/1974 | Delcano et al. | 271/90 |

FOREIGN PATENT DOCUMENTS

| | | | |
|---|---|---|---|
| 684092 | 6/1930 | France | 271/107 |
| 212097 | 3/1924 | United Kingdom | 271/104 |
| 473828 | 10/1937 | United Kingdom | 271/104 |

*Primary Examiner*—Bruce H. Stoner, Jr.
*Attorney, Agent, or Firm*—Jordan and Hamburg

[57] ABSTRACT

Suction feet are arranged to pick up and feed a sheet from a stack and a blower is arranged to blow air against the edges of the sheets on the stack to separate the top sheet from the rest. A cam assembly driven through a novel one-rotation clutch moves a piston in a cylinder which is connected to both the feet and blower so that the piston is moved in one direction to supply pressurized air to the blower and subsequently in the opposite direction to apply suction to the suction feet. A cylindrical presser member is carried by each suction foot which extends past the suction foot to bend the top sheet during pickup and further aid in separating the top sheet from the lower sheets.

7 Claims, 15 Drawing Figures

SHEET FEED MECHANISM COMPRISING ONE-ROTATION CLUTCH AND SUCTION FOOT ASSEMBLY

This is a continuation of application Ser. No. 666,295, filed Mar. 12, 1976, now abandoned.

The present invention relates to a sheet feed mechanism for a facsimile system or the like.

It is known in the art to pick up and feed sheets by means of suction feet which engage with the sheets from the top. The suction feet are hollow, and are supplied with negative gage pressure from a vacuum pump. A problem exists in the prior art in that when picking up a top sheet from a stack, one or more lower sheets are picked up along with the top sheet. One method of separating the top sheet from the lower sheets is to blow air against the edges of the sheets, while a presser holds down the center of the edges of the sheets. Provision of a separate pressure pump for this purpose adds to the cost and complexity of the system.

It is therefore an object of the present invention to provide a sheet feed mechanism which embodies a vacuum and pressure pump in a single cam actuated cylinder for blowing air against the edges of sheets in a stack and applying a suction force to suction feet for picking up only the top sheet of the stack.

It is another object of the present invention to provide a one-rotation clutch which constitutes a novel subcombination of the present sheet feed mechanism and finds utility in a wide variety of apparatus.

It is another object of the present invention to provide a suction foot assembly which constitutes another novel subcombination of the present sheet feed mechanism comprising a presser member fixed to a suction foot and extending past the suction foot to bend a top sheet picked up by the suction foot and thereby separate the top sheet from the lower sheets of a stack.

The above and other objects, features and advantages of the present invention will become clear from the following detailed description taken with the accompanying drawings, in which.

Figure 1:
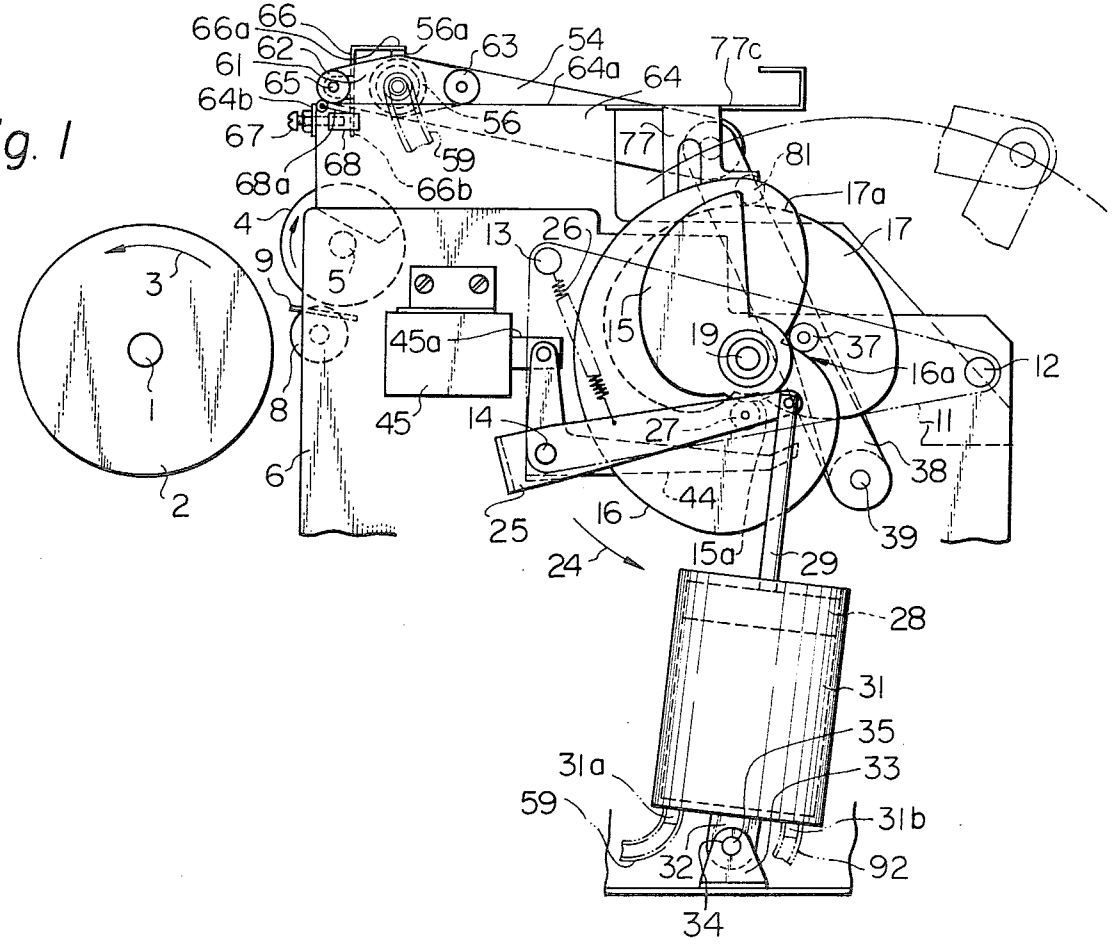
FIG. 1 is a longitudinal section of a sheet feed mechanism embodying the present invention.

Referring now to FIGS. 1 to 4, a rotary shaft 1 supports a drum 2 of a facsimile device or the like for rotation as shown by an arrow 3. A feed roller 4 mounted on a shaft 5 is rotatable as shown by an arrow to feed sheets which will be described below into contact with the surface of the drum 2. Side plates 6 and 7 rotatably support the feed roller 4 and other components of the system. A feed idler roller 8 is vertically movable through a cutout (no numeral) in a base plate 9 to cooperate with the feed roller 4.

A support plate 11 is fixedly mounted to the side plate 6 by means of shafts 12, 13 and 14. Disc cams 15, 16 and 17 are fixed together for integral rotation with a hollow shaft 16 which is rotatably mounted on a fixed shaft 19. A timing pulley 21 which constitutes a drive shaft is constantly driven for rotation as shown by an arrow 24 through a belt 23 from a drive means which is not shown. A ratchet 22 is integral with the pulley 21.

An arm 25 is pivotally supported by the shaft 14 and is biased counterclockwise in FIG. 1 by a tension spring 26 connected between an intermediate portion of the arm 25 and the fixed shaft 13. A roller 27 which serves as a cam follower is thereby urged into contact with the peripheral cam surface of the cam 15. A pressure supply means comprises a cylinder 31. A piston 29 is sealingly slidable in the cylinder 31 and is connected to the end of the arm 25 by a rod 29. The bottom end of the cylinder 31 is formed with a lug 32 by which it is pivotally connected to a fixed member 33 by means of a lug 34 extending from the fixed member 33 and a pin 35 pivotally connecting the lugs 32 and 34 together. The lower end of the cylinder 31 is formed with an inlet 31*a* and an outlet 31*b*.

An arm 38 is fixed to a shaft 39 which is rotatably carried by the side plates 6 and 7. A cam follower or roller 37 carried by the end of the arm 38 is biased into engagement in a manner which will be described below with the peripheral cam surface of the cam 16.

Figure 5:
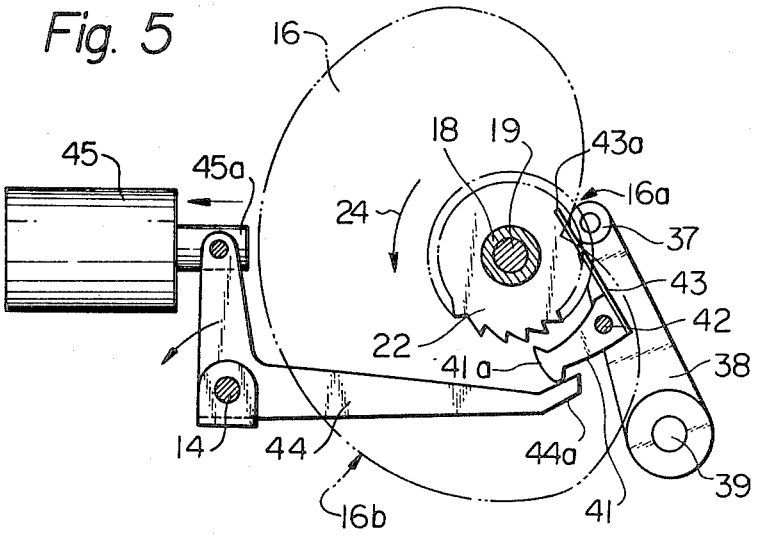
FIG. 5 is a side view of part of the cam assembly in an initial position.

Referring also to FIG. 5, a one-rotation clutch which constitutes a novel subcombination of the present sheet feed mechanism comprises the ratchet 22. The clutch is shown in a stationary position in which the roller 37, which further serves as a detent member, is engaged in a detent notch 16*a* of the cam 16 thereby holding the cams 15, 16 and 17 in the positions shown in FIGS. 1 and 5. A pawl is pivotally mounted on the cam 16 by a pin 42 adjacent to the detent notch 16*a*. The pawl 41 is formed with a tooth 41*a* at its end which is engagable with the teeth of the ratchet 22. A resilient arm 43 made of, for example, spring steel extends from the pawl 41 toward the detent notch 16*a*. A spring (not shown) may be provided to urge the pawl 41 clockwise in FIG. 5 so that the tooth 41*a* is urged toward engagement with the ratchet 22.

In the position shown in FIG. 5, the roller 37, engaged in the detent notch 16*a*, also engages with an end 43*a* of the arm 43 so as to rotate the arm 43 counterclockwise so that the tooth 41*a* disengages from the ratchet 22. The ratchet 22 thereby continuously rotates counterclockwise whereas the cams 15, 16 and 17 are held against rotation by the engagement of the roller 37 in the detent notch 16*a*.

A bellcrank lever 44 is pivotal about the shaft 14 and has an end 44*a* which is engagable with the pawl 41. The lever 44 is connected at its other end to an electrical solenoid 45 by means of a plunger 45*a* of the solenoid 45.

Figure 4:
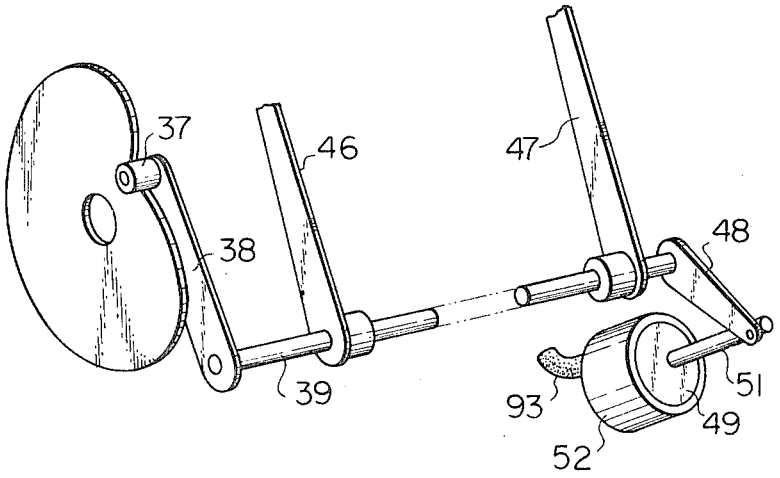
FIG. 4 is a perspective view of part of the cam assembly.

A shown in FIG. 4, rocker arms 46 and 47 are integrally rotatable with the shaft 39. An arm 48 is connected to a rod 51 of a piston 49 which is sealingly slidable in a dashpot cylinder 52. The end of the cylinder 52 is connected through a pipe 93 to a pipe 92 which is connected to the outlet 31*b* of the cylinder 31.

Figure 2:
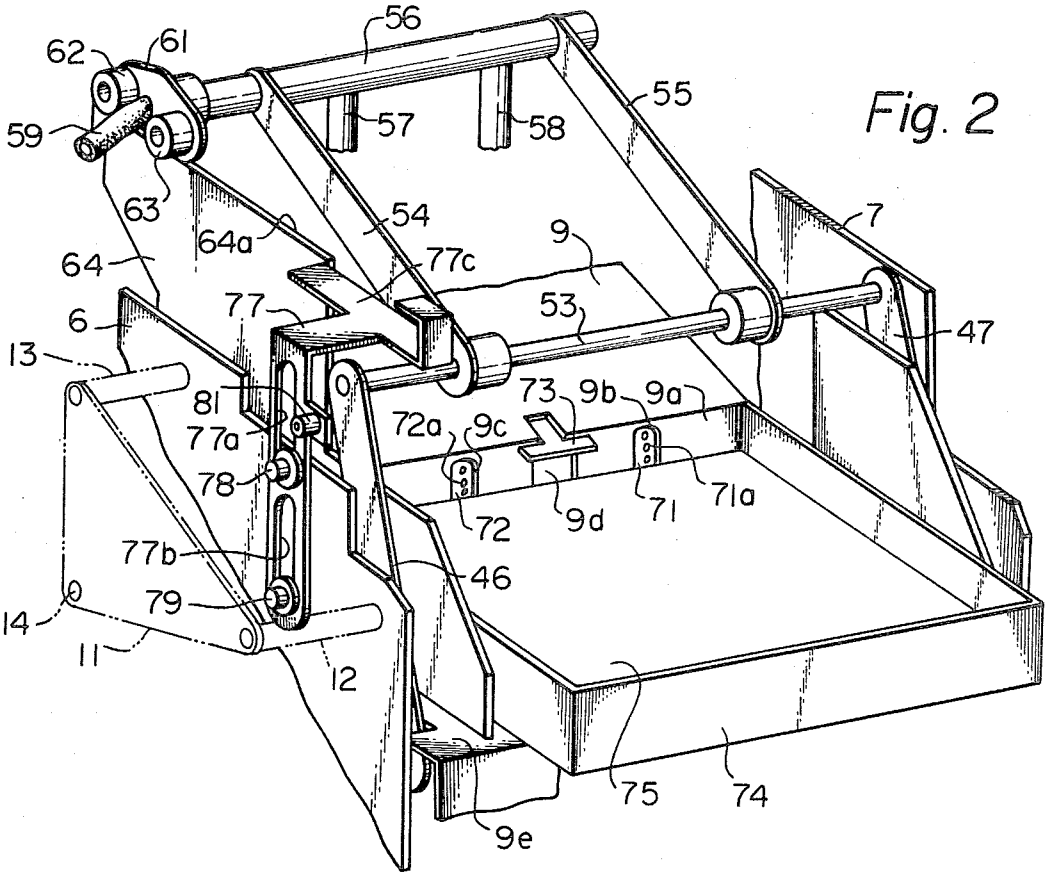
FIG. 2 is a perspective view of the sheet feed mechanism.
Figure 3:
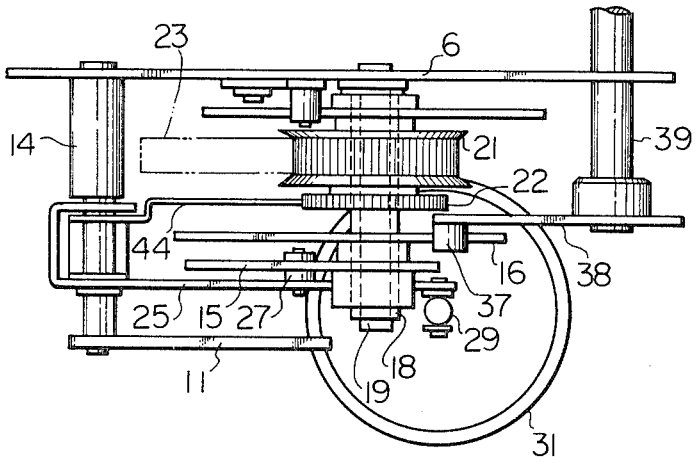
FIG. 3 is an overhead view of a cam and one-rotation clutch assembly of the sheet feed mechanism.

Referring now to FIG. 2, a shaft 53 is rigidly connected between the ends of the rocker arms 46 and 47. Links 54 and 55 pivotally connect the shaft 53 to a suction header pipe 56. Suction foot pipes 57 and 58 lead downward from the header pipe 56. A hose 59 connects the header pipe 56 to the inlet 31*a* of the cylinder 31.

A flange 61 fixed to the header pipe 56 rotatably carries rollers 62 and 63 which roll on a guide edge 64*a* of a guide plate 64. As shown in FIG. 1, a shaft 65 extending from the flange 61 which supports the roller 62 also rotatably supports a valve plate 66, an upper end 66*a* of which is arranged to control communication of the interior of the header pipe 56 with the atmosphere through a vent hole 56*a*. The valve plate 66 normally blocks the vent hole 56*a*, but is rotatable counterclockwise upon abutment of a bottom end 68*b* thereof against the right end of a bolt 67 screwably extending through a flange 64*b* of the guide plate 64 to unblock the vent hole 56*a*. The roller 62 is arranged to depress an actuator 68*a* a switch 68 in its leftmost position as shown in FIG. 1.

Figure 7:
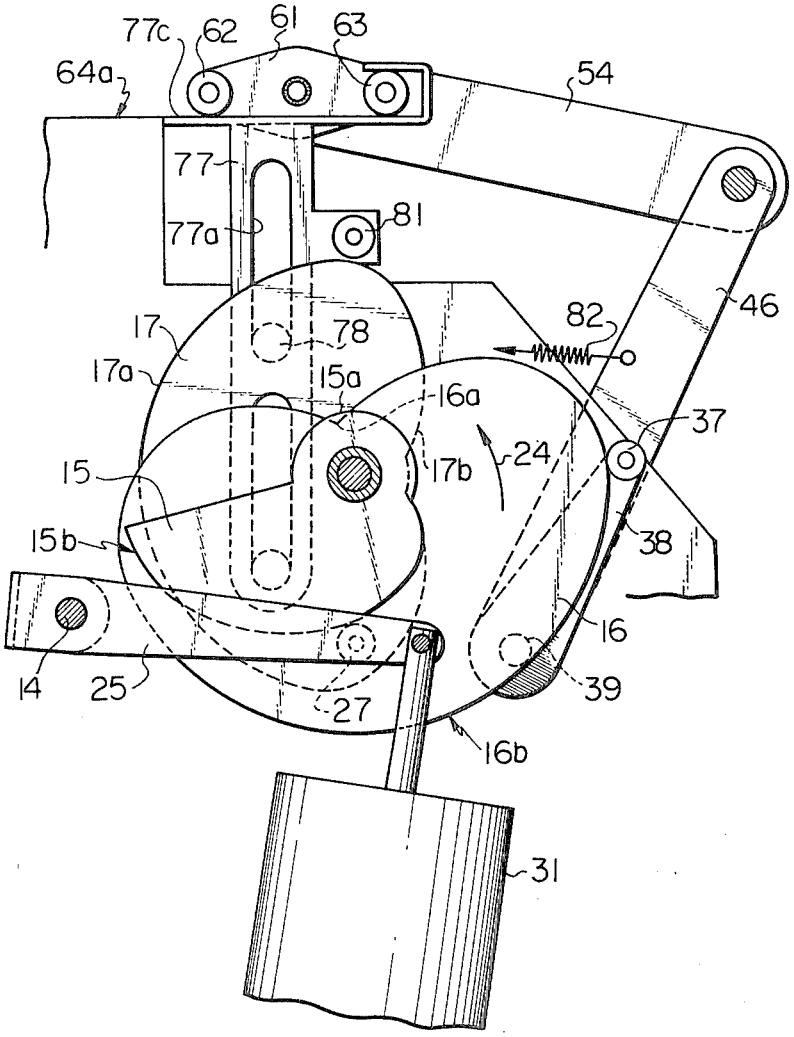
FIG. 7 is a more inclusive side view of the cam assembly in a first intermediate position.

Referring now to FIG. 2, blower pipes 71 and 72 are formed with blower orifices 71*a* and 72*a* respectively which face through holes 9*b* and 9*c* of a vertical extension 9*a* of the base plate 9. The pipes 71 and 72 are connected to the outlet 31*b* of the cylinder 31 through a pipe 91 (see FIG. 9) and the pipe 92. A vertically movable presser member 73 extends through a central hole 9*d* in the extension 9*a*. A recording sheet cassette 74 containing a stack of recording sheets 75 is detachably supportable by a horizontal member 9*e* of the base plate 9 so that the inner edges of the sheets 75 are adjacent to the blower orifices 71*a* and 72*a*. A vertically movable elevator 77 is formed with longitudinal slots 77*a* and 77*b* through which pins 78 and 79 extend respectively to vertically guide the elevator 77. A cam follower or roller 81 is rotatably mounted on the elevator 77 and engages with the peripheral cam surface of the cam 17. The elevator 77 has an upper horizontal portion 77*c* onto which the rollers 62 and 63 are rollable from the guide edge 64*a*. Shown in FIG. 7 is a strong tension spring 82 which biases the rocker arm 46 counterclockwise and the roller 37 into engagement with the cam 16.

Figures 9, 10:
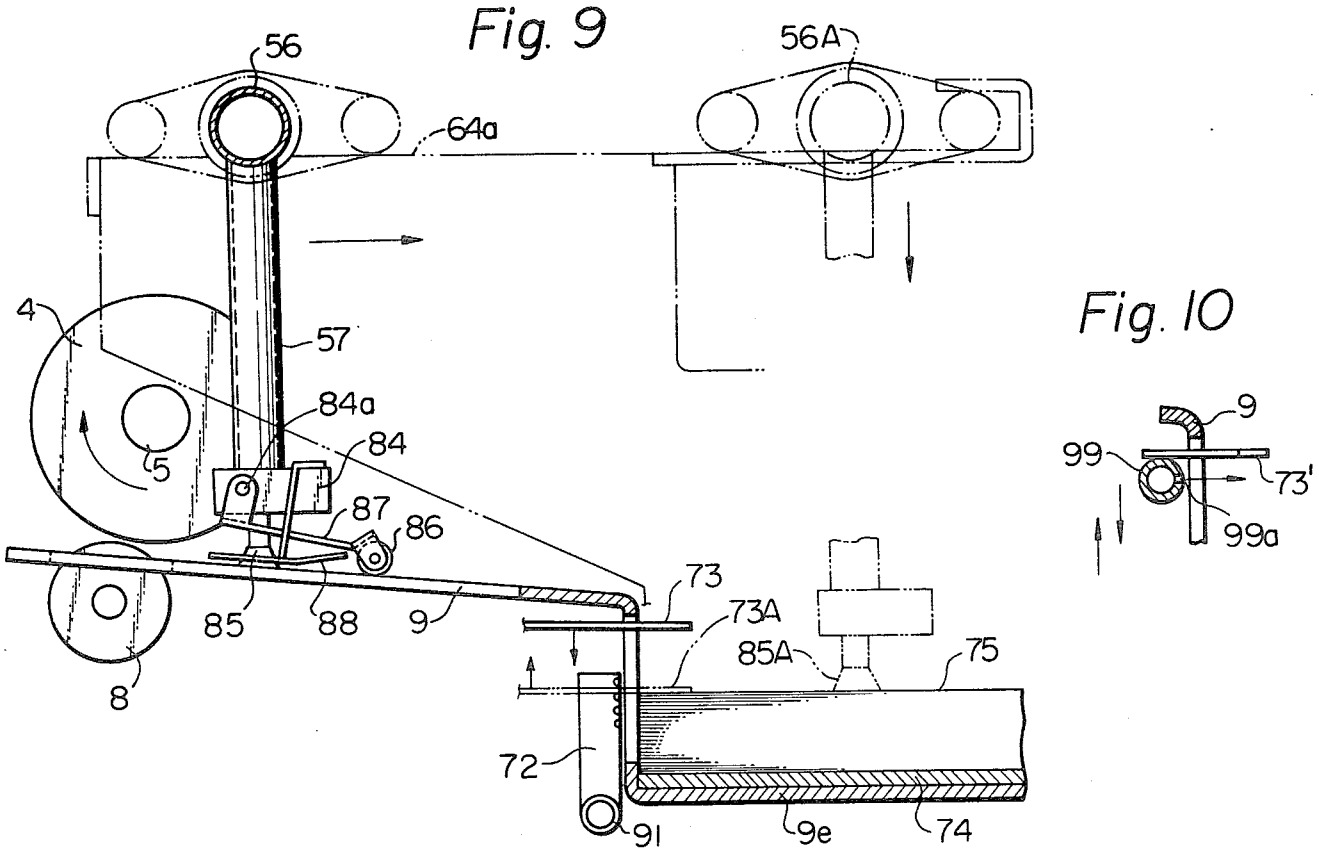
FIG. 9 is schematic view showing the operation of a suction foot assembly of the sheet feed mechanism.
FIG. 10 is a fragmentary cross section showing a modification of the sheet feed mechanism.
Figure 11:
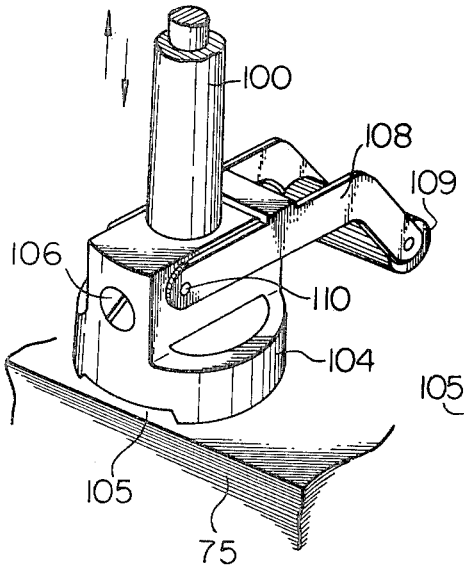
FIG. 11 is a perspective view of a modified suction foot assembly embodying the present invention.
Figure 12:
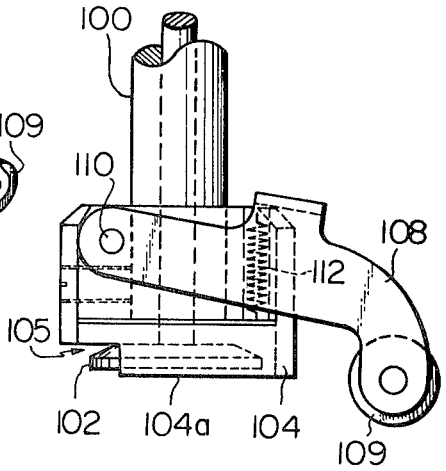
FIG. 12 is a cross section of the suction foot assembly shown in FIG. 11.
Figure 13:
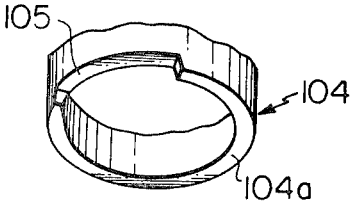
FIG. 13 is a fragmentary perspective view of a presser member of the suction foot assembly.

Referring now to FIG. 9, the pipe 57 terminates in a suction orifice or foot 85 which is engagable with the top of the sheets 75. A similar arrangement is provided for the pipe 58 although not shown. A block 84 is fixed to the pipe 57 and carries a pin 84*a* which pivotally supports an arm 87. A roller 86 is rotatably mounted to the end of the arm 87. A spring (not shown) may be provided to urge the arm clockwise in FIG. 9. A guide foot 88 is fixed to the suction foot 85.

The operation of the sheet feed mechanism will now be described with reference to the drawings. As shown in FIGS. 1, 2 and 5, in the stationary or inoperative condition of the sheet feed mechanism, the roller 37 is engaged in the detent notch 16*a* of the cam 16 thereby holding the cams 15, 16 and 17 against rotation. The rocker arms 46 and 47 are in their most counterclockwise positions in FIG. 1 and the rollers 62 and 63 and thereby the header pipe 56, suction foot pipes 57 and 58 and associated members are in their leftmost or sheet feed positions. The roller 27 is engaged with a small radius portion 15*a* of the cam 15, and the arm 25 is thereby rotated to its maximum counterclockwise position holding the piston 28 in its uppermost position. The roller 81 is engaged with a large radius portion 17*a* of the cam 17 thereby holding the elevator 77 in its uppermost position in which the horizontal portion 77*c* is substantially flush with the guide edge 64*a* of the guide plate 64. The lower end 66*b* of the valve plate 66 is in abutment with the right end of the bolt 67 thereby opening the vent hole 56*a* as described above. As shown in FIG. 4, the arm 48 is rotated counterclockwise holding the piston 49 in a position farthest from the pipe 93.

To feed a top one of the sheets 75 into operative contact with the drum 2 for a facsimile recording or other operation, the system operator depresses a button (not shown) which energizes the solenoid 45. The bellcrank lever 44 is thereby rotated counterclockwise in FIG. 6 to engage with the tooth 41*a* of the pawl 41.

Figure 6:
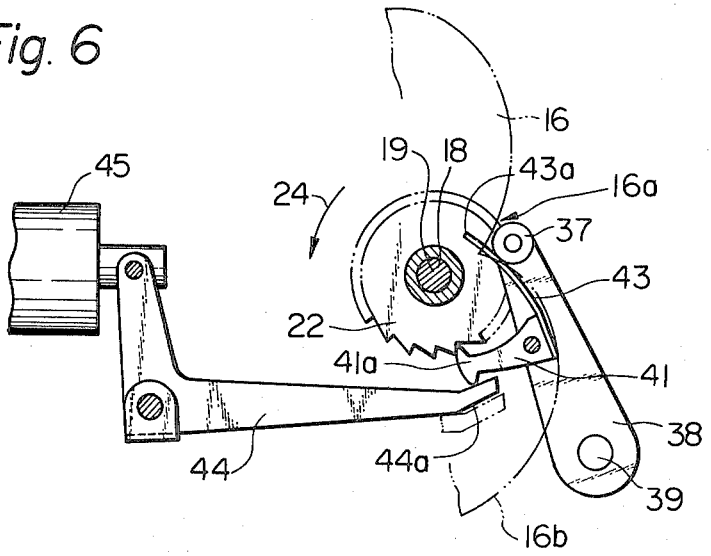
FIG. 6 is a side view of the part of the cam assembly as being actuated.

Referring further to FIG. 6, the end 44*a* of the lever 44 is moved from a broken line position to a solid line position to move the tooth 41*a* into operative engagement with the teeth of the ratchet 22. The resilient arm 43 is resiliently deformed during this operation. The cam 16 is thereby coupled to the ratchet 22 by means of the pawl 43, and the ratchet 22 and cams 15, 16 and 17 rotate counterclockwise in a unitary manner. As the roller 37 rolls onto a large radius portion 16*b* of the cam 16, the resilient arm 43 moves with the cam 16 in such a manner as to disengage from the roller 37.

Counterclockwise rotation of the cams 15, 16 and 17 moves the components of the sheet feed mechanism to the positions illustrated in FIG. 7. Specifically, the roller 27 rolls onto a large radius portion 15*b* of the cam 15 rotating the arm 25 clockwise and pushing the piston 29 downward toward the outlet 31*b*. This forces air out of the cylinder 31 at positive gage pressure through the pipes 92, 91, 71, 72 out of the blower orifices 71*a* and 72*a* against the edges of the sheets 75. The presser member 73 is moved by a mechanism which is not shown into engagement with the central portion of the top of the edges of the sheets 75. With the sheets 75 being held in the edge center and the air being blown against outer portions of the edges, the sheets 75 are separated from each other at the outer portions of their edges.

As further shown in FIG. 7, the roller 37 rolls onto a large radius portion 16*b* of the cam 16 thereby rocking the arms 38, 46 and 47 clockwise in a unitary manner. The header pipe 56 is pulled rightward by means of the links 54 and 55 so that the rollers 62 and 63 rest on the horizontal portion 77*c* of the elevator 77. The roller 81 is still in engagement with the large radius portion 17*a* of the cam 17, so that the elevator 77 remains in its uppermost position. Referring to FIG. 4, it will be seen that clockwise rotation of the arm 48 along with the arm 38 moves the piston 49 into the dashpot cylinder 52 to pump air at positive gage pressure through the pipes 93, 92 and 91 out of the blower orifices 71*a* and 72*a* to augment the air supplied from the cylinder 31.

Figure 8:
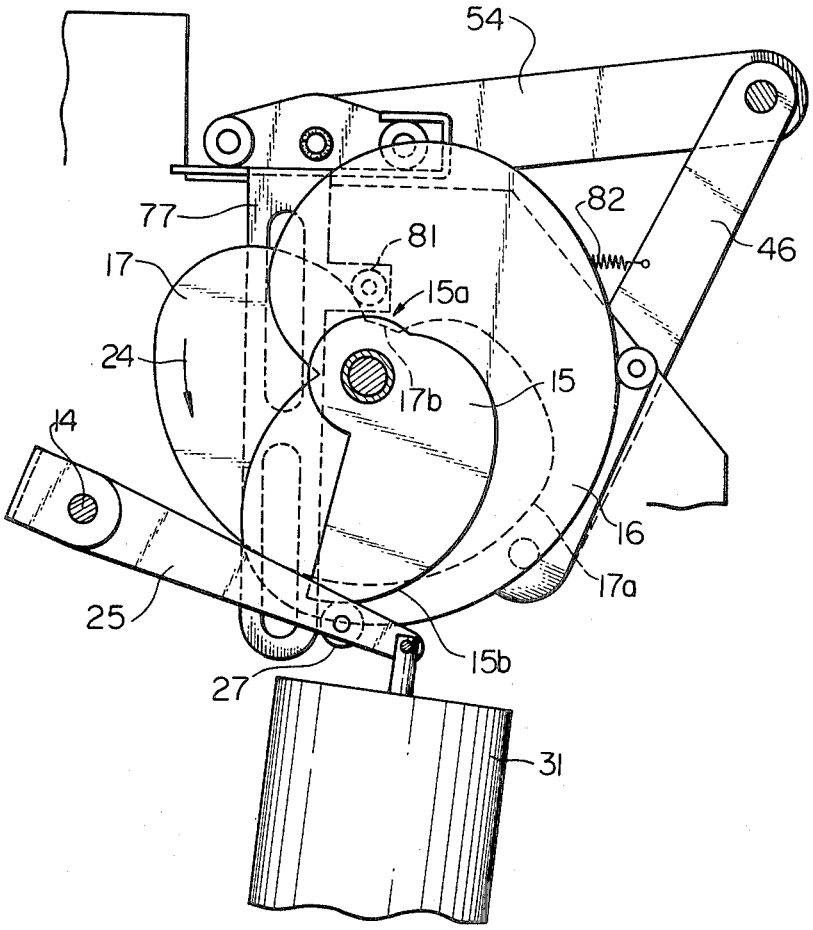
FIG. 8 is a side view of the cam assembly in a second intermediate position.

Referring now to FIGS. 8 and 9, further rotation of the cams 15, 16 and 17 causes the roller 81 to move onto a small radius portion 17*b* of the cam 17. The elevator 77 thereby drops to the position shown in FIG. 8. This operation is illustrated in FIG. 9 in which the header pipe 56 is moved downward from a position designated as 56A so that the suction foot 85 engages with the top of the sheets 75 as designated at 85A. The presser member 73 in its position of contact with the sheets is designated as 73A. The suction foot 85A is in a sheet engaging pickup position. Although not shown, the roller 86 also engages with the sheets 75. It will be noted that disengagement of the end 66*b* of the valve plate 66 from the bolt 67 causes the valve plate 66 to block the vent hole 56*a*.

A slight further rotation of the cams 15, 16 and 17 causes the roller 27 to roll onto a small radius portion 15*a* of the cam 15, whereby the arm 25 is rotated counterclockwise by the spring 26. This causes the piston 28 to move upward or away from the inlet 31*a* thereby creating a condition of negative gage pressure in the cylinder 31. This is applied through the pipes 59, 56 and 57 to the suction foot 85 to pick up the top sheet 75. The suction foot (not shown) associated with the pipe 58 is actuated in the same manner. Although not shown, the inlet 31*a* and outlet 31*b* may be provided with unidirectional valves to enhance the operation.

The presser member 73 is then raised, and further rotation of the cam 17 causes the roller 81 to roll onto the large radius portion 17*a* of the cam 17 thereby raising the elevator 77. The top sheet 75 is picked up by the suction foot 85 and held by means of the negative gage pressure in the cylinder 31.

After the elevator 77 reaches its uppermost position, the roller 37 rolls onto the small radius portion or detent notch 16*a* of the cam 16 thereby rocking the rocker arms 46 and 47 counterclockwise and moving the rollers 62 and 63 off the elevator 77 and to the leftmost or sheet feed position on the guide edge 64*a*. At this position, the sheet 75 held by the suction foot 85 is in the bite of the feed rollers 4 and 8. As the valve plate 66 is rotated counterclockwise by abutment with the bolt 67, the vent hole 56*a* is uncovered to allow atmospheric air to enter the header pipe 56. This action raises the pressure in the suction foot 85 to atmospheric and causes the suction foot 85 to drop the sheet 75 onto the base plate 9. Engagement of the roller 62 with the actuator 68*a* of the switch 68 signals to a control unit (not shown) that the sheet 75 is in the sheet feed position. The control unit then causes the idler feed roller 8 to move the sheet 75 upward against the feed roller 4 to feed the sheet 75 into operative contact with the drum 2 in proper synchronization with the angular position of the drum 2.

As the roller 37 moves into the detent notch 16*a*, it engages with the resilient arm 43 thereby rotating the same counterclockwise about the pin 42 as viewed in FIG. 5 so that the pawl 41 is disengaged from the ratchet 22. The roller 37 thereafter holds the cams 15, 16 and 17 stationary in the positions shown in FIG. 5. Although not shown, the cylinder 52 is provided with slow return or damping means such as a cap covering the end opposite to the pipe 93, the cap being formed with a small orifice. The purpose of the dashpot cylinder 52, in addition to supplementing the blower pressure as described above, is to slow the return of the roller 37 into the detent notch 16*a*. Since the spring 82 is necessarily quite strong in order to move the header pipe 56, etc. to the sheet feed position, due to the shape of the cam 16 the roller 37 has a tendency to rotate the cam 16 faster than the ratchet 22 when the roller 37 is nearing the detent notch 16*a*. If uncorrected, this would cause the pawl 41 to disengage from the ratchet 22 resulting in erratic operation of the one-rotation clutch. The provision of the dashpot cylinder 52 prevents excessively fast movement of the arm 48 and roller 37, thereby maintaining the pawl 41 in firm engagement with the teeth of the ratchet 22.

A modification of the invention is shown in FIG. 10, in which a blower pipe 99 is fixed for vertical movement to a presser member 73'. The pipe 99 is formed with one or more horizontally oriented holes 99*a*, and replaces the blower pipes 71 and 72. By this means, the holes 99*a* may be positioned at an optimum height with respect to the top sheet 75, thereby enhancing the blower effect. Whereas a plurality of vertically spaced blower orifices 71*a* and 72*a* are shown in FIG. 2, only one may be provided in FIG. 10. This allows a reduction in the size and in increase in the efficiency of the cylinder 31.

Referring now to FIGS. 11 to 15, a presser foot assembly (no numeral) which may replace the presser foot 85 and which constitutes a novel subcombination of the present sheet feed mechanism comprises a pipe 100 which is connected to the inlet 31*a* of the cylinder 31. The pipe 100 terminates in a suction foot 102. A block 104 is vertically slidable on the pipe 100 and fixed in the required position by a setscrew 106. An arm 108 is pivotally connected to the block 104 by a pin 110, and is urged clockwise in FIG. 12 by a tension spring 112 so that a roller 109 rotatably carried at the end of the arm 108 is urged into contact with the sheets 75. A lower portion 104*a* of the block 104 is generally cylindrical in shape and is formed with a radial cutout 105 which is arranged to face the edges of the sheets 75. In accordance with an important feature of the suction foot assembly, the end of the block 104 extends past the end of the suction foot 102. The blower orifices 71*a*, for example are aimed directly into the cutout 105 when the suction foot assembly engages with the top of the sheets 75.

Figure 14:
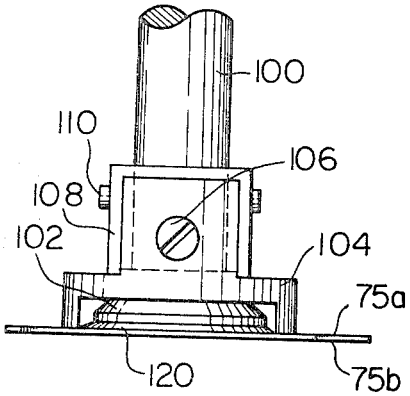
FIG. 14 is a front view of the presser foot assembly.
Figure 15:
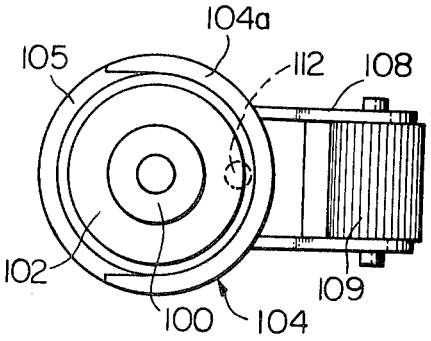
FIG. 15 is an end view of the presser foot assembly.

In operation, the bottom of the block 104 engages with top of the sheets 75 thereby pressing the sheets 75 downward. Negative gage pressure is then applied to the pipe 100 and suction foot 102 which causes a top sheet 75*a* to be suckably bent upward in the region surrounded by the block 104 relative to a bottom sheet 75*b* which remains flat. An air pocket 120 is thereby formed between the top and bottom sheets 75*a* and 75*b* as shown in FIG. 14. Air from the blower orifices 71*a* blown into this air pocket 120 positively separates the top sheet 75*a* from the bottom sheet 75*b* so that the suction foot assembly may reliably feed only the top sheet 75*a*. In some cases, the bending action of the suction foot assembly is operable to reliably separate the top sheet 75*a* from the bottom sheet 75*b* without a blower assembly. The suction foot assembly of FIGS. 11 to 15 thereby has utility in a sheet feed apparatus other than that of the present invention in that it can eliminate the need for a blower unit.

What is claimed is:

1. A one-rotation clutch assembly, comprising:

a rotary drive shaft;

a ratchet fixed for rotation with the drive shaft;

a disc formed with a detent notch rotatably mounted on the drive shaft;

a pawl rotatably carried by the disc adjacent to the detent notch;

a detent member biasingly urged against a periphery of the disc and operative to engage in the detent notch;

a resilient arm fixed at one end to the pawl and extending toward the detent notch;

the detent member, when engaged in the detent notch, engaging with the resilient arm so as to urge the pawl out of engagement with the ratchet; and actuating means actuable, when the detent member is engaged in the detent notch, to move the pawl into engagement with the ratchet by resiliently deforming the resilient arm to drivably connect the disc to the drive shaft, the resilient arm disengaging from the detent member when the detent member is disengaged from the detent notch.

2. A sheet feed mechanism comprising:

sheet support means;

substantially vertically oriented sheet engagable suction orifice means having a suction foot and a presser member carried by and surrounding the suction foot, an end of the presser member extending past an end of the suction foot;

pressure supply means to supply a negative gage pressure to the suction orifice means; and mechanism means comprising a first cam assembly to actuate the pressure supply means to supply a negative gage pressure to the suction orifice means while the suction orifice means moves from a sheet engaging pickup position to a sheet feed position and a second cam assembly to both horizontally move the suction orifice means between the sheet feed position and an intermediate position above the sheet engaging pickup position and vertically reciprocatingly move the suction orifice means between the intermediate position and the sheet engaging pickup position;

the mechanism means comprising a rotary drive shaft and a one-rotation clutch connecting the drive shaft to the suction orifice means, the one-rotation clutch comprising a ratchet fixed for rotation with the drive shaft, a disc formed with a detent notch rotatably mounted on the drive shaft, a pawl rotatably carried by the disc adjacent to the detent notch, a detent member biasingly urged against a periphery of the disc and operative to engage in the detent notch, a resilient arm fixed at one end to the pawl and extending toward the detent notch, the detent member, when engaged in the detent notch, engaging with the resilient arm so as to urge the pawl out of engagement with the ratchet, and actuating means actuable, when the detent member is engaged in the detent notch, to move the pawl into engagement with the ratchet by resiliently deforming the resilient arm to drivably connect the disc to the drive shaft, the resilient arm disengaging from the detent member when the detent member is disengaged from the detent notch.

3. The sheet feed mechanism of claim 2, in which the actuating means comprises an electrically actuated solenoid having a movable member engagable with the pawl.

4. The sheet feed mechanism of claim 2, in which the second cam assembly comprises a cam, a cam follower and a linkage connecting the cam follower to the suction orifice means, the cam comprising the disc, the periphery of the disc being formed with a cam surface, the cam follower comprising the detent member.

5. The sheet feed mechanism of claim 2, further comprising a dashpot connected to the detent member to slow movement of the detent member into the detent notch.

6. A sheet feed mechanism comprising:

sheet support means;

substantially vertically oriented sheet engagable suction orifice means having a suction foot and a presser member carried by and surrounding the suction foot, an end of the presser member extending past an end of the suction foot;

pressure supply means to supply a negative gage pressure to the suction orifice means;

mechanism means comprising a first cam assembly to actuate the pressure supply means to supply a negative gage pressure to the suction orifice means while the suction orifice means moves from a sheet engaging pickup position to a sheet feed position and a second cam assembly to both horizontally move the suction orifice means between the sheet feed position and an intermediate position above the sheet engaging pickup position and vertically reciprocatingly move the suction orifice means between the intermediate position and the sheet engaging pickup position; and blower orifice means facing an edge of the sheet support means, the pressure supply means being actuated by the first cam assembly when the suction orifice means is in the sheet engaging position to supply a positive gage pressure to the blower orifice means;

the pressure supply means comprising a cylinder, a piston sealingly slidable in the cylinder for reciprocating movement by the first cam assembly, a pressure passageway leading from the cylinder to the blower orifice means, and a suction passageway leading from the cylinder to the suction orifice means, the pressure passageway and the suction passageway extend through a same end portion of the cylinder.

7. A sheet feed mechanism comprising:

sheet support means;

substantially vertically oriented sheet engagable suction orifice means having a suction foot and a presser member carried by and surrounding the suction foot, an end of the presser member extending past an end of the suction foot;

pressure supply means to supply a negative gage pressure to the suction orifice means;

mechanism means comprising a first cam assembly to actuate the pressure supply means to supply a negative gage pressure to the suction orifice means while the suction orifice means moves from a sheet engaging pickup position to a sheet feed position and a second cam assembly to both horizontally move the suction orifice means between the sheet feed position and an intermediate position above the sheet engaging pickup position and vertically reciprocatingly move the suction orifice means between the intermediate position and the sheet engaging pickup position; and blower orifice means facing an edge of the sheet support means, the pressure supply means being actuated by the first cam assembly when the suction orifice means is in the sheet engaging position to supply a positive gage pressure to the blower orifice means;

the pressure supply means comprising a cylinder, a piston sealingly slidable in the cylinder for reciprocating movement by the first cam assembly, a pressure passageway leading from the cylinder to the blower orifice means, and a suction passageway leading from the cylinder to the suction orifice means;

the first cam assembly moving the piston in a first direction to supply the positive gage pressure to the blower orifice means and in a second direction which is opposite to the first direction to supply the negative gage pressure to the suction orifice means.

* * * * *